US009527125B2

(12) United States Patent
Golovashchenko

(10) Patent No.: US 9,527,125 B2
(45) Date of Patent: Dec. 27, 2016

(54) DRAW DIE SET WITH ROLLING ELEMENTS ON PUNCH AND DRAW DIE CAVITY

(75) Inventor: Sergey Fedorovich Golovashchenko, Beverly Hills, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 1101 days.

(21) Appl. No.: 13/526,066

(22) Filed: Jun. 18, 2012

(65) Prior Publication Data

US 2013/0333435 A1 Dec. 19, 2013

(51) Int. Cl.
*B21D 37/10* (2006.01)

(52) U.S. Cl.
CPC ..... *B21D 37/10* (2013.01)

(58) Field of Classification Search
CPC ..... B21D 5/042; B21D 5/08; B21D 5/12; B21D 7/063; B21D 5/14; B21D 5/01; B21D 7/04; B21D 7/08; B21D 11/203; B21D 35/00; B21D 7/025; B21D 22/22; B21D 24/08; B21D 24/04; B21D 24/06; B21D 11/02; B21D 22/18; B21D 5/04; B21D 5/06; B21D 22/24; B21D 22/28; B21D 37/00; B21D 37/10; H01L 21/4842; H05K 13/0092; B21B 2001/221; B21B 1/224; B21B 3/005; B21B 3/02; B21B 5/042; B30B 3/06
USPC ..... 72/389.3, 389.5, 396, 383, 389.8, 213,72/319, 294, 212, 210, 219, 216, 217, 350,72/366.2, 347, 348, 351, 220, 72, 112; 104/105
See application file for complete search history.

(56) References Cited

U.S. PATENT DOCUMENTS

| | | | | |
|---|---|---|---|---|
| 531,337 | A * | 12/1894 | Saltzkorn et al. | 72/350 |
| 1,596,262 | A * | 8/1926 | Walker | B21D 39/12 72/75 |
| 2,988,208 | A * | 6/1961 | Loew | 229/123.1 |
| 3,613,427 | A * | 10/1971 | Haddon | 72/212 |
| 3,900,192 | A | 8/1975 | Gibson | |
| 4,603,541 | A * | 8/1986 | Medwed | B29C 51/04 493/338 |
| 5,375,630 | A * | 12/1994 | Kim | 140/105 |
| 5,832,963 | A * | 11/1998 | Hornisch | 140/105 |

FOREIGN PATENT DOCUMENTS

| | | |
|---|---|---|
| GB | 824638 | 12/1959 |

* cited by examiner

*Primary Examiner* — Teresa M Ekiert
(74) *Attorney, Agent, or Firm* — Damian Porcari; Brooks Kushman, P.C.

(57) ABSTRACT

A draw die set defines a die cavity. A die entry area is provided at the location where a blank is drawn into the die cavity. A plurality of rolling elements such as cylindrical rollers or spherical balls are retained in pockets formed at the die entry area. A punch may be provided with rolling elements that engage a blank on the opposite side from the rollers in the die entry area. The rollers in the die entry area and on the punch may be arranged in rows that form a tangent surface that engages the sheet metal blank as it is drawn into the die cavity.

13 Claims, 2 Drawing Sheets

DRAW DIE SET WITH ROLLING ELEMENTS ON PUNCH AND DRAW DIE CAVITY

TECHNICAL FIELD

This disclosure relates to sheet metal draw dies and methods of drawing sheet metal parts.

BACKGROUND

Drawing sheet metal blanks into three dimensional shapes is the established method of forming metal parts that are assembled to manufacture vehicles, appliances and other large products. Drawing operations are modeled by taking into account the physical properties of the blank and die set.

A simplified analytical formula that defines radial stresses for drawing a cylindrical cup is provided below:

$$\sigma=(\sigma_y 1n(R/r)+\mu Q/(\pi Rt)+\sigma_y t/(4R_{die}+2t))\exp(\mu\pi/2)$$

First Term Second Term Third Term Fourth Term—multiplier

Where:

$\sigma_y$—yield stress

R—radius of the flat blank at the beginning of the process r—radius of the die at the entry to the cavity μ—friction coefficient Q—flange clamping force

π—3.14 t—sheet metal thickness $R_{die}$—radius of the edge of the die (usually 10 t or so)

Four major components identified as terms the $1^{st}$ through fourth terms that make up the fundamentals of sheet metal drawing include:

First Term—plastic deformation of the flange

Second Term—friction between the die flange and the blank holder

Third Term—bending and unbending the sheet metal

Fourth Term—friction of the sheet metal with the die at the radius of the die entry The first and third components are inherent in drawing operations and are generally unavoidable.

The second component relating to friction on the flange is minimized, or avoided, by employing the draw beads that force sheet metal to flow across the draw bead that creates tensile radial stresses. This technique is widely used today and allows sheet material drawing without clamping material on the entire flange. This approach minimizes the impact of the second component.

The fourth component is the friction of the sheet metal with the die at the radius of the die entry, and it has the most pronounced effect on the drawing process. The friction at the die entry is characterized as an exponential function. For example, if the fourth term friction coefficient is assumed to be 0.15, the multiplier is 1.29. If the friction coefficient is equal to the dry friction value (0.3 . . . 0.5), the multiplier is 1.57 . . . 2.17. Since the component defining plastic deformation of material in the flange is listed as ln(R/r), the ability to increase this term by 1.29 means that the ratio of R/r can be increased by exp(1.29)=3.65. Since height of the drawn cup is proportional to the surface of the flange ($R^2-r^2$), the increase of R more than factor of three makes a huge difference in the depth of draw. This effect is limited by bending-unbending term. Friction reduction makes a visible difference in the efficiency of the drawing operation. The fourth term is important for aluminum applications where a deep draw operation is required, such as door inner or fender applications.

Frictional forces limit the ability to draw sheet metal into the die cavity. Lightweight materials, such as aluminum alloys, require extending drawing limits to approach the ability to be drawn to the extent that is possible with mild steels.

Sheet metal part producers are developing lubrication technology to substantially reduce the coefficient of friction and increase the maximum draw depth. However, the most efficient lubrication systems often work in a narrow temperature window. As the temperature increases, the coefficient of friction increases. In high volume production conditions, especially when ambient temperatures are high, increased die temperatures are almost inevitable. Higher temperatures cause changes in drawing limits, and also changes the restraining forces that define wrinkling and spring back of parts after drawing.

This invention is directed to addressing the above problems and other problems that cause a reduction in drawing operation limits as summarized below.

SUMMARY

The disclosed solution is to use rolling elements such as rollers or balls at the die entry radius to reduce friction at the die entry radius. Friction is dramatically reduced by the rolling elements that result in rolling friction instead of friction with a lubricated static surface.

According to one aspect of this disclosure, a draw die set is disclosed that comprises a draw die defining a die cavity within a die entry area that defines at least one pocket, a binder ring that clamps a blank to the draw die, and a punch drawing the blank into the die cavity. At least one rolling element is disposed within each pocket that engages the blank and reduces friction between the blank and the die entry area.

According to other aspects of this disclosure, a plurality of pockets may be defined by the draw die and a plurality of ball bearings may be disposed within the pockets. Alternatively, a plurality of pockets may be defined by the draw die, and a plurality of roller bearings may be disposed within the pockets. In a further alternative, a plurality of pockets may be defined by the draw die and a plurality of ball bearings and a plurality of roller bearings may be disposed within the pockets, with the ball bearings being located in areas of substantial curvature and the rollers being located in straight areas or areas with limited curvature.

According to another aspect of the disclosure, the pockets may be arranged in several rows that extend about the die cavity. The rolling elements may be disposed in the pockets arranged in several rows form a tangent surface that the blank is drawn over as the blank enters the die cavity.

The punch may define at least one punch pocket on a surface that engages the blank and may further comprise at least one rolling element disposed in the punch pocket. The punch pocket may be defined at a lower edge of the punch, so that the at least one rolling element initially engages the blank on a side of the blank that is opposite the die entry area of the draw die.

According to another aspect of the disclosure, a punch of a draw die set is provided that comprises a draw die defining a die cavity, a binder ring clamping a blank to the draw die, and a punch that draws the blank into the die cavity that defines at least one pocket. At least one rolling element is disposed within each pocket that engages the blank and reduces friction between the blank and the punch.

According to a further aspect of the disclosure as it relates to the punch with rolling elements, the punch pockets may be defined at a lower edge of the punch, and the rolling elements initially engage the blank on a side of the blank that is opposite the die entry area of the draw die.

According to another aspect of this disclosure, a method of drawing a blank in a draw die set to form a shaped part is provided that includes a draw die that defines a die cavity within a die entry area, a binder ring, and a punch. The die entry area defines a plurality of pockets that each receives a rolling element. The method comprises loading a blank into the draw die set, moving the punch toward the die cavity, drawing the blank over the rolling elements in the die entry area and into the die cavity to form the shaped part, and removing the shaped part from the die cavity.

According to other aspects of the disclosed method, the punch may define a punch pocket on a surface that enters the die cavity. The punch pocket receives a rolling element that engages the blank.

According to another aspect of the method of drawing a blank in a draw die set, the method comprises loading the blank into the draw die set, drawing the blank into a die cavity across a rolling element retained in a die entry area to form the blank into a shaped part, and unloading the shaped part from the die cavity.

According to other aspects of the method, a plurality of rolling elements may be retained in a plurality of pockets in the die entry area. The plurality of rolling elements may be disposed in a series of rows that form a tangent surface that the blank is drawn over, as the blank enters the die cavity. The drawing step may further comprise engaging the blank with a punch that includes a second rolling element retained by the punch, wherein the second rolling element engages an opposite side of the blank from a side of the blank engaged by the rolling element supported by the die entry area. A plurality of second rolling elements may be retained in a plurality of pockets on the punch. The plurality of second rolling elements may be disposed in a series of rows that form a second tangent surface that engage the opposite side of the blank from the die entry area.

These and other aspects of the disclosure will be better understood in view of the attached drawings and the following detailed description of the illustrated embodiments.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
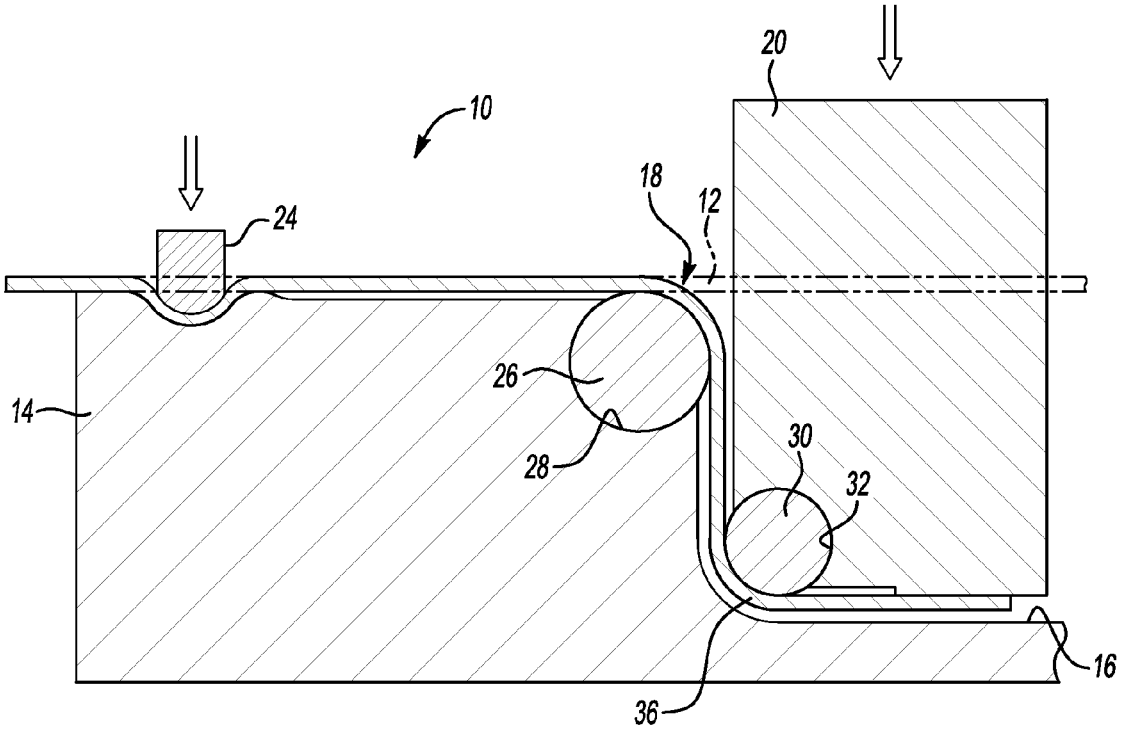
FIG. 1 is a diagrammatic cross-sectional view of a sheet metal draw die during a drawing operation.

Referring to FIG. 1, a draw die set 10 is shown with a blank 12 that is partially shown in phantom lines to indicate its initial flat shape. The draw die set 10 includes a draw die 14 that defines a die cavity 16. A die entry area 18 is provided on the draw die 14 where the blank 12 is formed into the die cavity 16. A punch 20 engages the blank 12 to draw the blank 12 into the die cavity 16 across the die entry area 18. A binder ring 24, or similar clamping device, clamps the blank 12 against the draw die 14 to restrain the blank 12 from wrinkling or becoming deformed when the punch 20 draws the blank 12 into the die cavity 16.

A rolling element 26 is provided on the pocket 28 defined by the draw die 14 in the die entry area 18. The rolling element 26 may be in the form of a ball, a cylinder, a barrel, or the like. The rolling element 26 reduces the friction between the sheet metal and the die at the radius of the die entry area 18. The rolling elements at the die entry area 18 greatly reduce friction in comparison to conventional die entry radiuses that are solid radiused edges that are generally merely lubricated to reduce friction. The reduction in friction realized by the inclusion of rolling elements 26 in pockets 28 greatly reduces friction compared to a lubricated static surface and minimizes the effect of the fourth factor referenced above in the background section.

Punch rolling elements 30 may be provided in punch pockets 32 that are defined by the punch 20. The punch rolling elements 30 substantially reduce friction on the top surface of the blank, as the blank is drawn into the die cavity 16 and formed into the drawn part 36. Friction in the die entry area 18 is substantially reduced by allowing the sheet metal blank to be rolled across the die entry area. Rolling the sheet metal reduces friction at the both the die entry and the punch radius.

Figure 2:
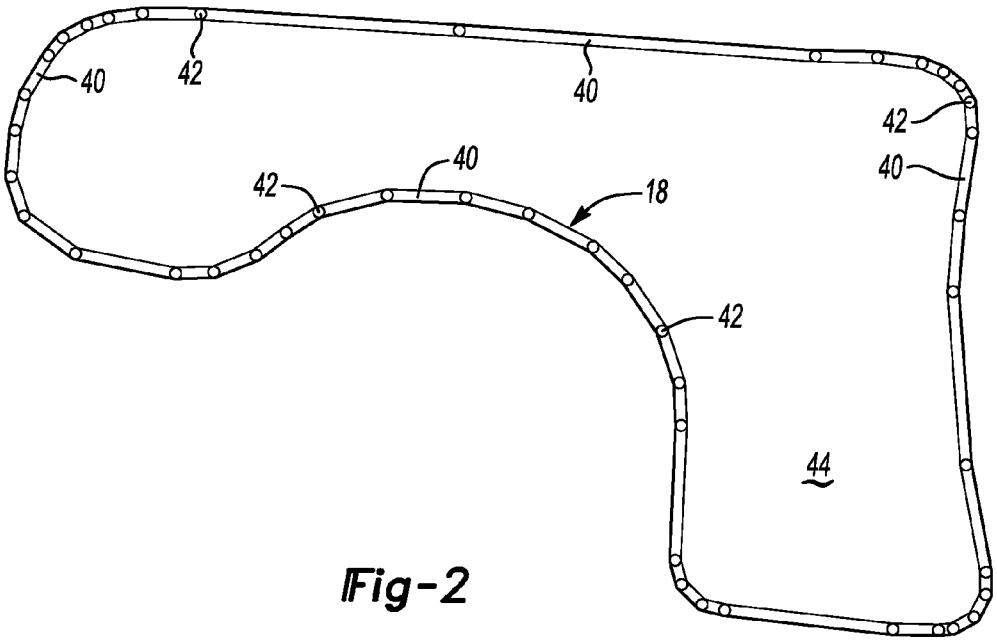
FIG. 2 is diagrammatic view of a die entry area of a draw die having a plurality of rollers and ball bearings disposed in a pocket formed around the die entry area.

Referring to FIG. 2, a plurality of cylindrical rollers 40 and spherical balls 42, or ball bearings, are shown disposed about a quarter panel die opening 44. The quarter panel die opening 44 is a complex shape that is intended as an example. It should be understood that the concepts disclosed may be adapted to a wide variety of panel shapes.

Figure 3:
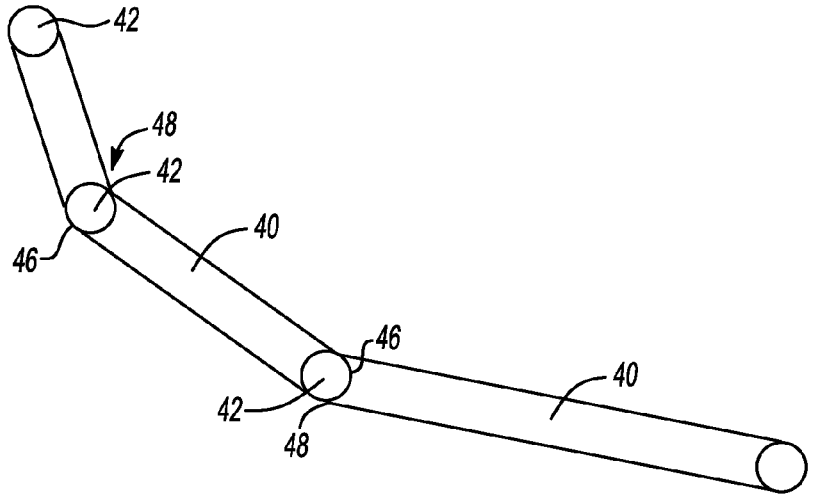
FIG. 3 is a view of a few of the rollers and ball bearings shown in FIG. 2 showing the spherical concave ends of the rollers receiving the ball bearings.

Referring to FIG. 3, the cylindrical rollers 40 and spherical balls 42 are enlarged to show the relationship between the cylindrical rollers 40 and the spherical balls 42. A partially spherical concave surface 46 is provided on each of the ends 48 of the cylindrical rollers 48. The spherical surface of the spherical balls 42 are complimentary to the partially spherical concave surface 46 provided on each end 48 of the cylindrical rollers 40. The length of the cylindrical rollers 40 may be reduced to accommodate greater curvature in some areas while longer cylindrical rollers 40 may be used in areas where the die entry area 18 is relatively straight. In areas of more pronounced curvature, a plurality of spherical balls 42 may be placed side by side with no cylindrical rollers 40 between the spherical balls 42.

Figure 4:
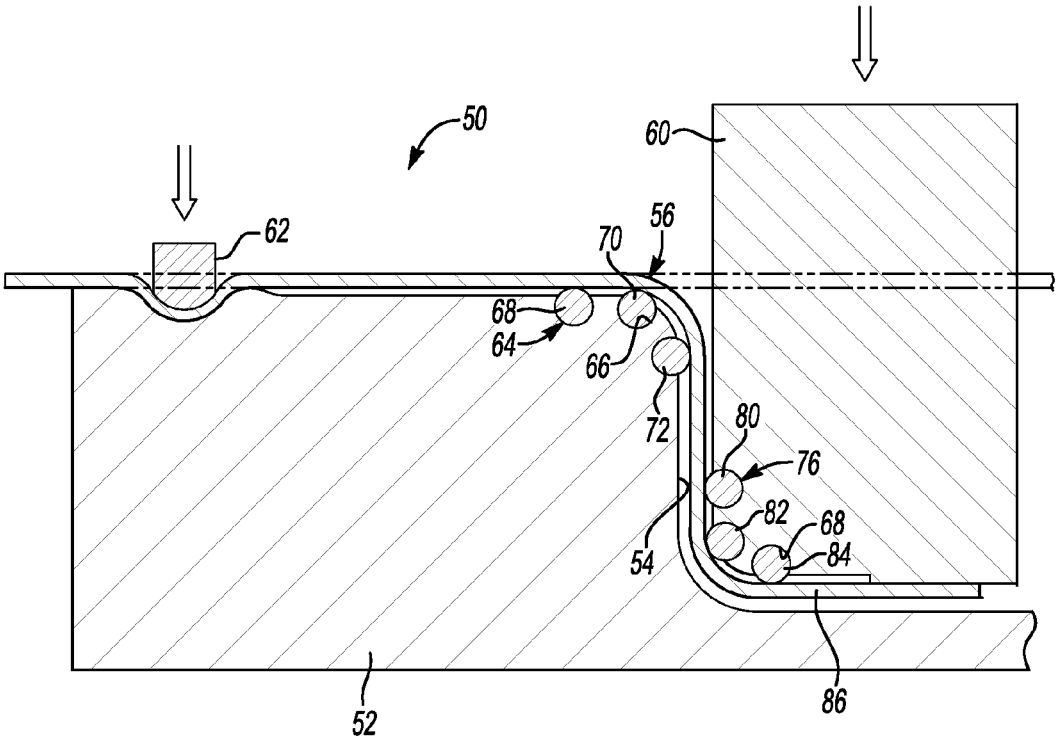
FIG. 4 is a diagrammatic cross-sectional view of an alternative embodiment of a sheet metal draw die during a drawing operation that shows a die entry area and a punch that each have three rows of rolling elements.

Referring to FIG. 4, an alternative embodiment of a draw die set 50 is diagrammatically illustrated. The draw die set 50 includes a draw die 52 that defines a die cavity 54. A die entry area is generally indicated by reference numeral 56. A punch 60 is adapted to engage the blank to draw the blank into the die cavity 54. A binder ring 62 holds the blank in engagement with the draw die 52. A plurality of rolling elements, generally indicated by reference numeral 64, are assembled into die entry area pocket 66. The rolling elements 64 are arranged in three rows including an outer row 68, an immediate row 70, and an inner row 72. The smaller rolling elements 64 are aligned in rows to form a tangent surface around the die entry area across which the sheet metal blank is drawn by the punch 60 into the die cavity 54.

The punch 60 is also provided with punch rolling elements 76 that are received in punch pockets 78. The punch rolling elements 76 may be disposed in rows including an outer row 80, an immediate row 82 and an inner row 84. The rolling elements 76 may form a tangent surface that contacts the blank, as it is drawn into the die cavity 54 to form a drawn part 86.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A draw die set comprising:

a draw die defining a die cavity within a die entry area that defines a plurality of pockets;

a binder ring clamping a blank to the draw die;

a punch drawing the blank into the die cavity; and a plurality of ball bearings and a plurality of roller bearings are disposed in a row around the die entry area within the pockets, with the ball bearings being located in areas of substantial curvature and the roller bearings being located in areas with limited curvature, and wherein the ball bearings are received by spherical concave surfaces on two ends of the roller bearings, wherein the ball bearings and roller bearing form a tangent surface engaged by the blank and that reduces friction as the blank is drawn into the die entry area.

2. The draw die set of claim 1, wherein the pockets are arranged in several rows that extend about the die cavity.

3. The draw die set of claim 2, wherein the ball bearings and roller bearings disposed in the pockets arranged in several rows form a tangent surface that the blank is drawn over as the blank enters the die cavity.

4. The draw die set of claim 1, wherein the punch defines at least one punch pocket on a surface that engages the blank and further comprising ball bearings and roller bearings disposed in the punch pocket.

5. The draw die set of claim 4, wherein the at least one punch pocket is defined at a lower edge of the punch and the ball bearings and roller bearings initially engage the blank on a side of the blank that is opposite the die entry area of the draw die.

6. A draw die set comprising:

a draw die defining a die cavity within a die entry area that defines a plurality of draw die pockets;

a binder ring clamping a blank to the draw die;

a punch drawing the blank into the die cavity, wherein the punch defines a plurality of punch pockets; and a plurality of ball bearings and a plurality of roller bearings are disposed in a row around the die entry area within the punch pockets, with the ball bearings being located in areas of substantial curvature and the roller bearings being located in areas with limited curvature, and wherein the ball bearings are received by spherical concave surfaces on two ends of the roller bearings to form a tangent surface and reduce friction between the blank and the punch when the blank is drawn into the die cavity.

7. The draw die set of claim 6, wherein the punch pockets are defined at a lower edge of the punch and the ball bearings and roller bearings initially engage the blank on a side of the blank that is opposite the die entry area of the draw die.

8. A method of drawing a blank in a draw die set to form a shaped part, the draw die set including a draw die that defines a die cavity within a die entry area, a binder ring, and a punch, wherein the die entry area defines a plurality of pockets and the method comprising:

a plurality of ball bearings and a plurality of roller bearings are disposed within the pockets, with the ball bearings being located in areas of substantial curvature and the roller bearings being located in areas with limited curvature, and wherein the ball bearings are received by spherical concave surfaces on two ends of the roller bearings;

loading a blank into the draw die set;

moving the punch toward the die cavity;

drawing the blank over a tangent surface formed by the ball bearings and roller bearings in the die entry area and into the die cavity to form the shaped part; and removing the shaped part from the die cavity.

9. The method of claim 8, wherein the punch defines a plurality of punch pockets on a surface that enters the die cavity, wherein the punch pockets receive ball bearings and roller bearings that engage the blank.

10. A method of drawing a blank in a draw die set comprising:

loading the blank into the draw die set;

drawing the blank into a die cavity across a plurality of ball bearings and roller bearings retained in a die entry area to form the blank into a shaped part, wherein the ball bearings are disposed in areas around the die cavity that have greater curvature than the areas where the roller bearings are disposed around the die cavity;

engaging the blank with a punch that includes a second plurality of ball bearings and roller bearings retained by the punch, wherein the second plurality of ball bearings and roller bearings engage opposite sides of the blank from a side of the blank engaged by the ball bearings and roller bearings supported by the die entry area; and unloading the shaped part from the die cavity.

11. The method of claim 10, wherein the plurality of ball bearings and roller bearings are disposed in a series of rows that form a first tangent surface that the blank is drawn over as the blank enters the die cavity.

12. The method of claim 10 further comprising a plurality of second ball bearings and roller bearings retained in a plurality of pockets on the punch.

13. The method of claim 12, wherein the plurality of second ball bearings and roller bearings are disposed in a series of rows that form a second tangent surface that engage the opposite side of the blank.

* * * * *